US005111621A

United States Patent [19]

Meyers

[11] Patent Number: 5,111,621

[45] Date of Patent: May 12, 1992

[54] METHOD AND APPARATUS FOR CLADDING WINDOW FRAMES

[76] Inventor: Leo J. Meyers, 125 McAlister Dr., Pittsburgh, Pa. 15235

[21] Appl. No.: 643,451

[22] Filed: Jan. 18, 1991

[51] Int. Cl.[5] ..... E06B 1/04

[52] U.S. Cl. ..... 49/504; 49/506; 52/764; 52/825

[58] Field of Search ..... 49/504, 501, 506; 52/475, 764, 710, 825, 826

[56] References Cited

U.S. PATENT DOCUMENTS

| | | | |
|---|---|---|---|
| 314,438 | 2/1891 | Meyers | D25/119 |
| 4,558,536 | 12/1985 | Dunsmoor | 49/501 X |
| 4,676,026 | 6/1987 | Schreiner | 49/504 X |
| 4,724,646 | 2/1988 | Meyers | 52/90 X |
| 4,875,311 | 10/1989 | Meyers | 52/90 |

*Primary Examiner*—Philip C. Kannan
*Attorney, Agent, or Firm*—Jon M. Lewis

[57] ABSTRACT

A window and portal frame assembly for a building which comprises an elongate inner frame section and pane holding frame section with the portal frame and pane frame section slidingly connected to one another by an intermediate window slide mechanism. Both sections have rigid pronged projections and grooved decorative strips having their grooves cooperatively connected over the pronged projections. In both the frame sections the decorative strips act as a more efficient insulating barrier and in the pane holding frame one of the decorative strips forms one of two opposing abutment surfaces for holding the pane in place in the frame.

30 Claims, 3 Drawing Sheets

METHOD AND APPARATUS FOR CLADDING WINDOW FRAMES

FIELD OF INVENTION

This invention has to do with portal opening having sliding glass partitions and is especially concerned with double hung windows and doors that slide open and closed.

BACKGROUND OF THE INVENTION

Portable and easily installed window frames, window slide mechanisms and pane holding frames are known that are usually comprised solely of extruded vinyl or aluminum material. The qualities that are desired in such installations are that they be easily manufactured, easily installed, durable for the lifetime of their installation, provide an efficient thermal insulation, provide sufficient mechanical strength to perform their function, and be decorative in their appearance.

To date the materials of extruded vinyl and aluminum have been found preferable for such installations, although installations using steel materials have been known. Aluminum laminated constructions having certain other material overlaid on the aluminum have also been known.

Constructions using solely extruded vinyl have mechanical strength drawbacks along with limited choices with regard to their decorative appearance.

Extruded aluminum possesses the mechanical strength requirements but has limitations with regard to the heat insulating properties and decorative appearance, both throughout its lifetime and in the choices of decorative appearance. Aluminum usually will pit if not anodized to protect it from the sweating that occurs during temperature changes and anodizing only offers a few choices of colors for the decorative appearance.

All steel constructions do not offer the most effective heat insulation condition that can be achieved by the use of the vinyl and aluminum materials and laminating such materials as the vinyl, the aluminum or the steel not only increases the expense of manufacture of such constructions but also does not offer lifetime decorative properties due to the fact that the laminations depend on adhesives for their attachment, with such adhesives trapping moisture between the laminate and the base material that can cause corrosion to the base material.

Applicant has already applied for and received U.S. Pat. No. 4,875,311 having to do with a simulated beam construction comprised of a core member having laterally arranged prongs or barbs for attachment of wood, laminated wooden, or plastic planks that attach to the barbs or prongs.

BRIEF SUMMARY OF THE INVENTION

According to the present invention there is disclosed a portal frame for a building which comprises an elongate inner frame section, preferably formed of extruded aluminum, for fitting around the perimeter of an opening through a constructed wall wherein the opening is to have a window or sliding glass doors placed therein. The inner frame section or sections are designed to be connected to one another so as to form a rectangular of polygonal frame in the constructed wall of a building. The inner frame section has oppositely facing front and back sides and oppositely facing lateral sides. The back side forms an abutment surface for abutting the inner frame section to the inside perimeter of an opening to be framed. The front side has means provided thereon for releasable attachment to one or more window slide mechanisms. Along and extending outwardly from one of the lateral sides there is provided rigid pronged connections that join strips of grooved decorative material. The grooves in the decorative material are co-operatively attached over the pronged projections so as to substantially cover the visible portion of the one lateral side.

Preferably the means for attachment to the window slide mechanisms comprises two independent attachment means, each for attachment to individual window slide mechanisms. Each independent means extends along the length of the lateral sides and intermediate the center of the inner frame and each lateral side of the inner frame. Preferably the independent means are comprised of channels having opposing abutment surfaces facing each other.

The invention further contemplates a frame section for holding a window pane which comprises an elongate body, preferably extruded aluminum, having opposing inside and outside surfaces. Intermediate the inside and outside surfaces there is located a window pane holding abutment surface. The frame section further has means for slidingly connecting to a window slide mechanism located intermediate of the inside and outside surfaces and on an opposite side from the pane holding abutment surface and further comprises rigid pronged projections extending along the inside surface. Strips of grooved decorative material are then provided having their grooves co-operatively connected over the rigid pronged projections so as to substantially cover the inside surface.

Preferably the pane holding abutment surface comprises a channel having two side walls and a bottom wall joining said two side walls and even more preferably one of the side walls is formed by one or more of the strips of decorative material. In order to achieve this preferably the rigid pronged projections face the same direction as the bottom wall and the inside surface is stepped in configuration having at least two landed surfaces from which the rigid pronged projections may protrude. On these landed surfaces there are placed at least two strips of decorative material with the innermost strip being only a fraction of the width of the outermost strip.

The present invention further contemplates a window and portal frame assembly for a building which comprises an elongate inner frame section having oppositely facing front and back sides and oppositely facing lateral sides. The back side forms an abutment surface for abutting the inner frame to a framed opening in a flush manner. The front side has means thereon for releasable attachment to more than one window slide mechanism. Rigid pronged projections extend outwardly from one of the lateral sides and strips of grooved decorative material have their grooves co-operatively attached over the pronged projections so as to substantially cover that one lateral side. Additionally there is an intermediate window slide mechanism connecting the portal frame to an elongate pane frame body having opposing inside and outside surfaces. There is a window pane holding abutment surface intermediate the inside and outside surfaces and means on the pane frame body for slidingly connecting to a window slide mechanism located intermediate of the inside and outside surfaces and on an opposite side from the pane holding abutment surface. Rigid pronged projections extend along the inside surface with strips of grooved decorative material having their grooves co-operatively connected over the rigid pronged projections so as to substantially cover the inside surface.

The invention further contemplates the method of providing a window pane frame which comprises the steps of extruding a piece of aluminum so as to form an elongate body having opposing inside and outside surfaces. Forming a window pane holding abutment surface intermediate of the inside and outside surfaces by providing a side wall and bottom wall substantially at right angles to one another. Providing means for slidingly connecting the aluminum to a window slide mechanism and forming rigid pronged projections extending along the inside surface. A further step comprises forming strips of grooved decorative material and co-operatively connecting their grooves over the rigid pronged projections so as to substantially cover the inside surface so that an opposing abutment side wall to said first abutment side wall is formed from one of the strips of decorative material.

OBJECTS OF THE INVENTION

It is an object of the present invention to provide long lasting, decorative, and heat insulating window frames.

It is an object of the present invention to provide more efficiently manufactured portal and window frames.

It is an object of the present invention to simplify the manufacture and maintenance of portal and window frames.

It is an object of the present invention to provide decorative wood clad window and portal frames.

It is an object of the present invention to provide more efficiently constructed, longer lasting, warmer, and more decorative portal and window frame construction.

DETAILED DESCRIPTION OF THE DRAWINGS

Figure 1:
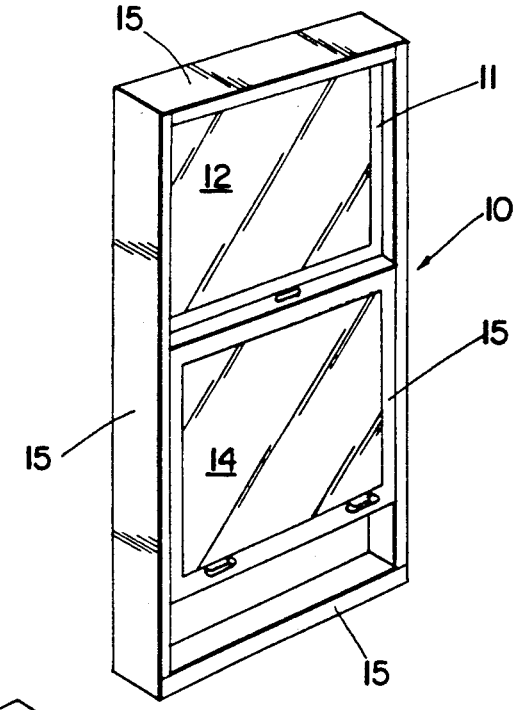
FIG. 1 is a perspective view of a window and portal frame according to the present invention.

What is shown in FIG. 1 is a double hung vertically sliding portal and window frame assembly 10 according to the present invention. On Assembly 10 are two pane holding window frames 11 and 13, holding window panes 12 and 14 respectively, and mounted so as to be able to slide the individual window frames 11 and 13, either up or down as desired. The perimeter of the frame assembly 10 is constructed with an inner frame section 15 that is sized and configured so that its perimeter and inner frame members 15 mount flush with an already existing opening in the structure of a building.

Figure 2:
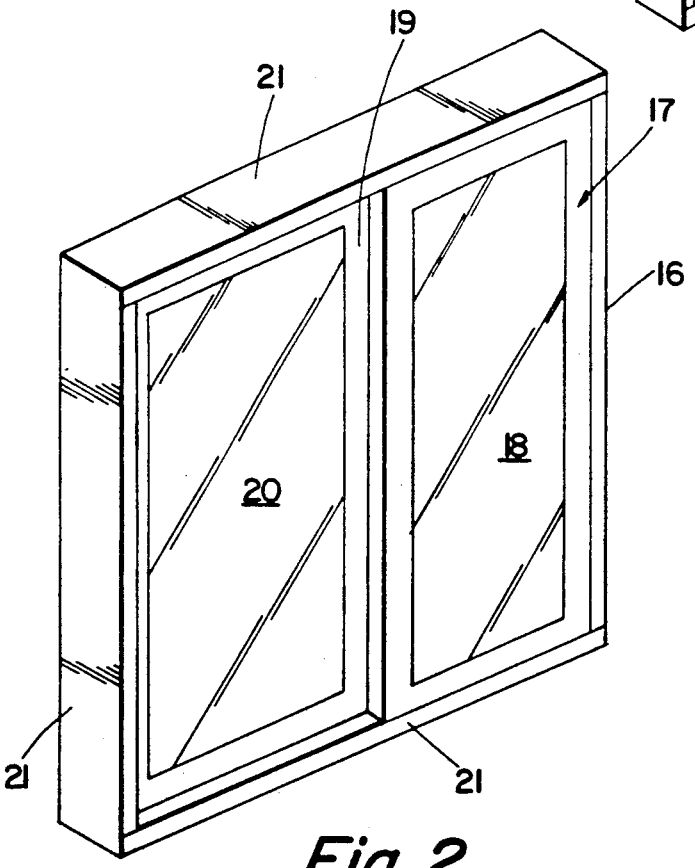
FIG. 2 is a perspective view of another window and portal frame according to the present invention.

Shown in FIG. 2 is another type window frame assembly 16 (which may be a sliding door assembly), according to the present invention, that embodies the same concepts as that shown in FIG. 1, only in this case the portal opening and window frames show horizontally sliding pane holding frames 17 and 19 having glass panes 18 and 20 respectively. Frame assembly 16 has its outer perimeter formed by inner frame members 21, which are also constructed so that the frame assembly 16 will fit flush in an already existing opening in a building.

Figure 3:
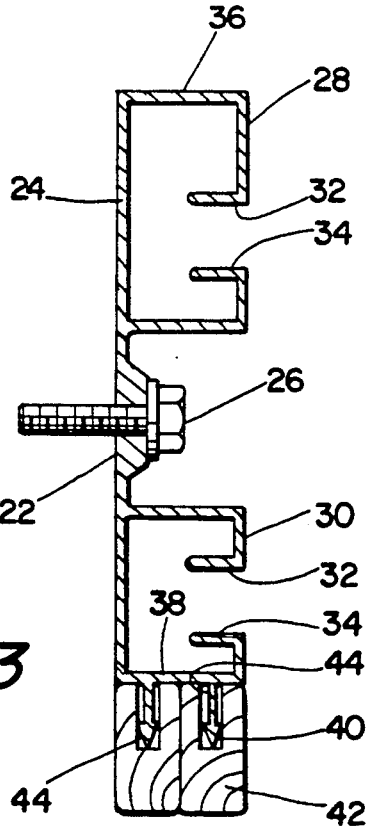
FIG. 3 is an end view of a portal frame according to the present invention.

Shown in FIG. 3 is a top view of an inner frame section 22 having a substantially planar surface 24 that may be mounted flush in an already existing and framed opening in a building. Inner frame 22 has a mounting bolt or fastener 26 that extends through the inner frame 22 so that it may be securely held to an existing building frame (see 130 in FIG. 6). The inner frame member 22 has shown thereon longitudinally extending and oppositely located box-like configurations 28 and 30, that in this case serve as a means for attachment to a window slide mechanism which will be described later. The box-like constructions 28 and 30 have formed thereon opposing channel and/or abutment surfaces 32 and 34, and serve to engage and hold the inner frame member 22 to a window slide mechanism. The inner frame 22 is preferably made of extruded aluminum, although it may also be made of other materials such as extruded vinyl, steel or fiberglass. Inner frame member 22 has lateral sides 36 and 38, and on side 38 there are rigid prong projections 40 that preferably extend continuously along the lateral edge 38 of the inner frame member 22. Strips of decorative material 42 have longitudinally extending grooves 44 formed therein so that grooves 44 co-operatively attach to the rigid, and barbed, prong projections 40, and the strips of decorative material 42 abut one another so as to substantially cover the lateral surface of the inner frame member 22. The decorative materials are preferably comprised of a wood material and most preferably comprised of a wood material selected from the group of oak, maple, walnut, cherry, poplar or cedar. The decorative material may also be selected from a colored vinyl material.

Figure 4:
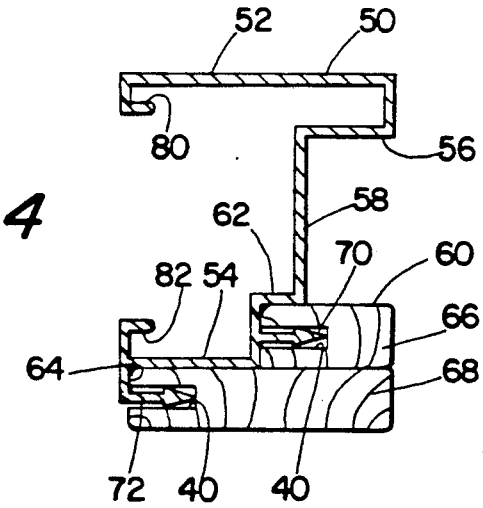
FIG. 4 is an end view of a window frame according to the present invention.

Shown in FIG. 4 is a window pane member 50 with the pane holding frame 50 having an outer sidewall 52 and an inner sidewall 54 with a window pane receiving abutment area formed by surfaces 56, 58, and 60. The pane receiving abutment area is formed by the bottom wall 58 joining the sidewalls 56 and 60. In a preferred embodiment, the inner sidewall 54 is formed with stepped surface areas 62 and 64, with each of the stepped surface areas 62 and 64 having rigid pronged projections 40 extending therefrom (and preferably continuously therealong). Decorative strips 66 and 68 are shown formed with grooves 70 and 72 in the decorative strips 66 and 68 such that the decorative strips have their grooves co-operatively attached to the rigid prong connections 40. Preferably one of the opposing walls 60 is formed by the decorative strip 66, and is attached to the frame member. Engagement means 80 and 82 are shown and can captively engage the pane holding frame 50 to a window slide mechanism.

Figure 5:
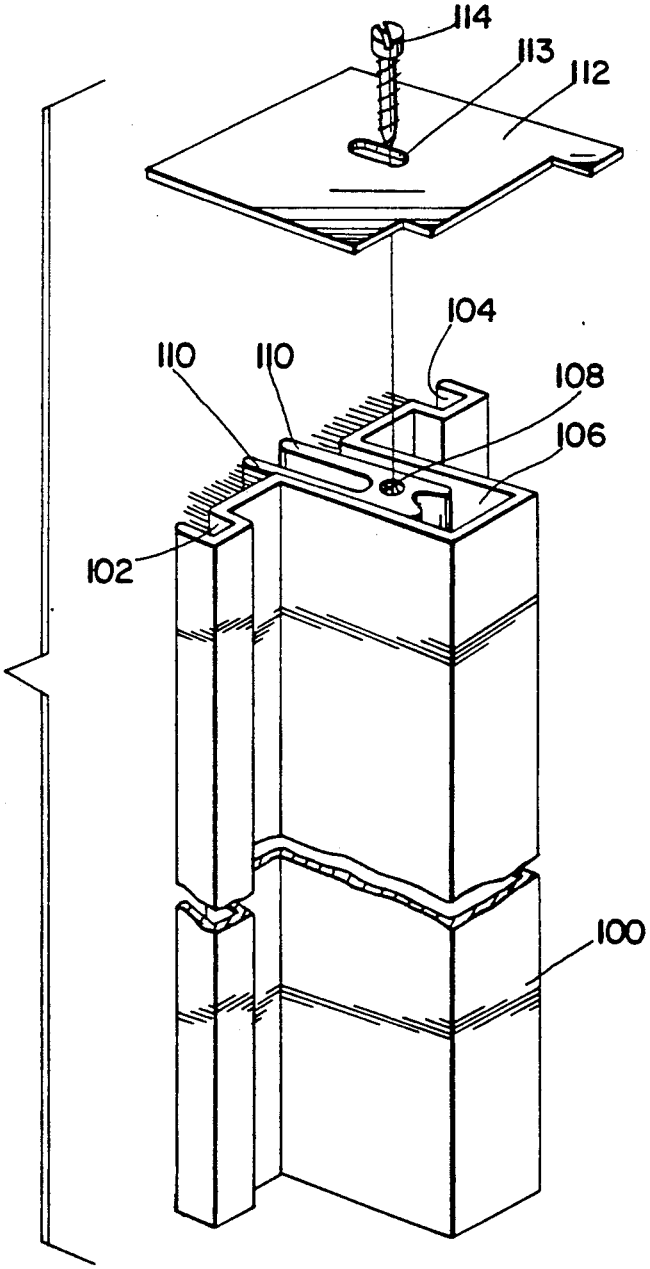
Fig. 5 PRIOR ART
FIG. 5 is a perspective view of a window slide mechanism.

Shown in FIG. 5 is a window slide mechanism 100 which is usually made of an extruded vinyl material. What is shown is meant to be a typical window slide mechanism that might be found in the prior art. Grooves are shown formed at 102 and 104 and provide for co-operative attachment mechanism to the channel areas 80 and 82 (shown in FIG. 4) so that window pane frame member 52 may captively be engaged by the window slide mechanism 100, and slide up and down in relation thereto. The window slide mechanism 100 has a further groove shown at 106 in which an elongate slide member 108 is placed, and is slideable along the width and length of the groove 106, so that the legs 110 and the slide member 108 may fit inside the opposing channels or abutment surfaces 32 and 34 of the portal frame 22 so as to abut against at least one and preferably both the sides 32 and 34 in those channels. The top plate 112 is shown having a threaded member 114, such that when the window pane assembly Frame 52 is attached to the window slide mechanism 100, that the projecting stud or slide member 108 may slide so that the legs 110 of the stud member 108 will engage the abutment surfaces 32 and 34 shown in FIG. 3. In this manner, the entire assembly, both the portal frame and window pane frame assembly will be attached one to the other. Plate 112 has a slot 113 that allows fastener means 114, when loosened, to slide member 108 to its desired position in groove 106.

Figure 6:
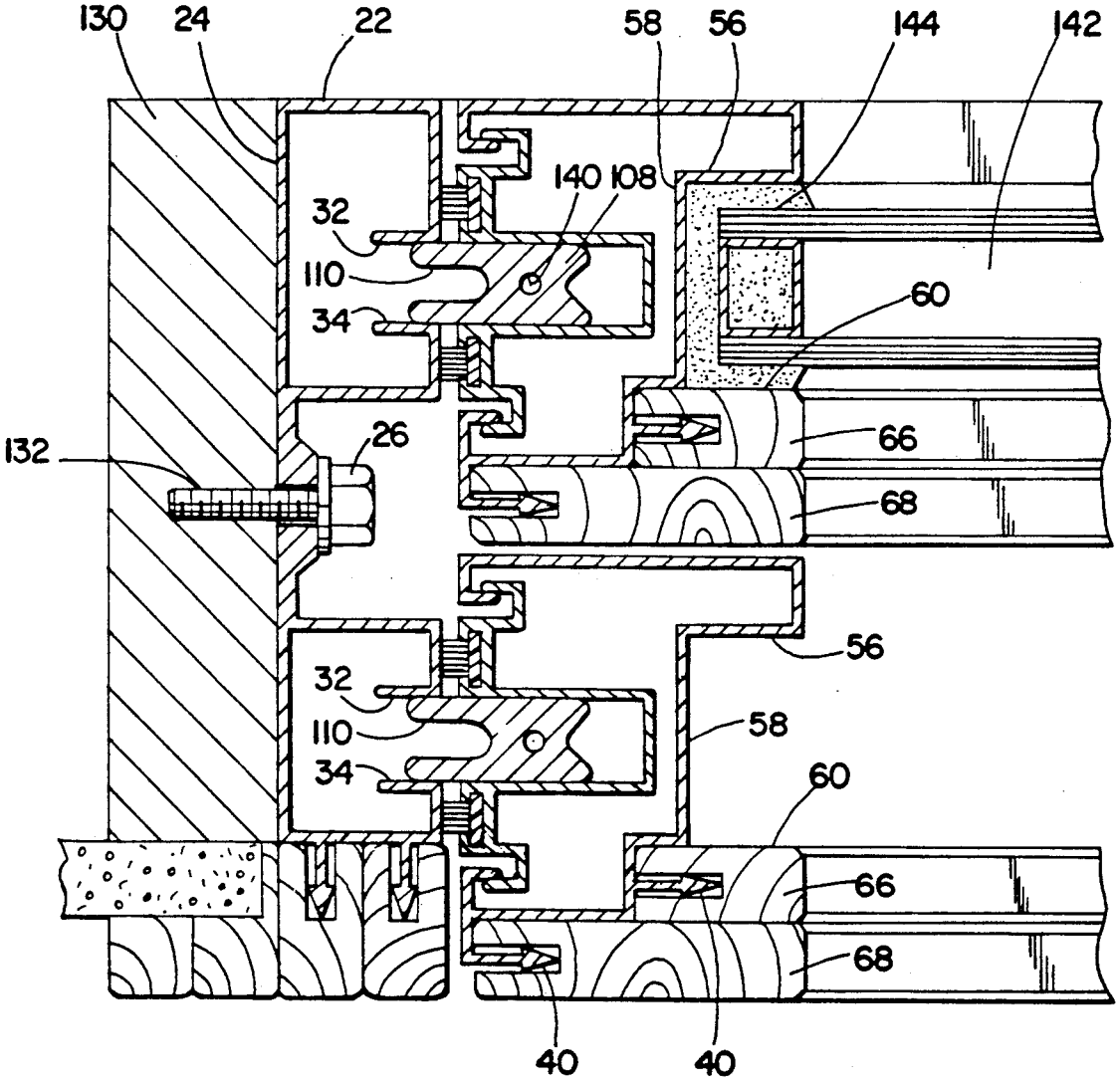
FIG. 6 is a plan view of the assembled window and portal frame of the present invention.

Shown in FIG. 6 is the entire window assembly, that includes a rough frame wall section 130 shown mounted flush to the inner portal frame 22 with the surface 24 of 22 mounted flush to the frame 130. Inner frame 22 is fastened to 130 by the threaded fastener 26 which engages co-operating threads in wall 130. Channels 32 and 34 of the portal frame 22 are shown engaging the ends 110 with the projecting slide 108. Projecting slide 108 when moved so as to engage surfaces 32 and 34 with legs 110 will hold the window slide mechanism 100 captive with the inner frame 22 but will allow legs 110 to slide vertically in relation to surfaces 32 and 34. Disengaging projecting slide 108 from 32 and 34 and out of the box-like projections allows the window slide mechanism and the window frame member 50 to be removed from assembly with the inner frame 22. Also shown in FIG. 6 is a representative pane of glass 142 that is shown along with a sealing compound 144, sitting in the channel formed by the surfaces 56, 58, and 60, such that the pane 142 will be held captive in the channel with the decorative strip 66 forming the side 60 to hold the pane 142 in place.

Whereas a particular embodiment of the invention has been described above for purposes of illustration, it will be evident to those skilled in the art that numerous variations of the details may be made without departing from the scope of the invention as defined in the appended claims.

I claim:

1. A portal frame for a building which comprises:

a. an elongate inner frame section having oppositely facing front and back sides and oppositely facing lateral sides;

b. said back side forming an abutment surface for abutting said inner frame to a framed opening;

c. said front side having means thereon for releasable attachment to window slide mechanisms;

d. rigid pronged projections extending outwardly from one of said lateral sides;

e. strips of grooved decorative material having their grooves co-operatively attached over said pronged projections so as to substantially cover said one lateral side.

2. The portal frame for a building according to claim 1 in which said means for attachment to said window slide mechanisms comprises two independent means, each for attachment to individual window slide mechanisms with each independent means extending along the length of said lateral sides intermediate the center of said inner frame and the lateral sides of said inner frame.

3. The portal frame for a building according to claim 2 in which said independent means comprises channels having opposing abutment surfaces facing each other.

4. The portal frame for a building according to claim 3 in which said elongate inner frame section is formed of extruded aluminum.

5. The portal frame for a building according to claim 4 in which said strips of decorative material comprise wood materials selected from the group of oak, maple, walnut, cherry, poplar or cedar.

6. The portal frame for a building according to claim 3 in which said elongate inner frame section is formed of an extruded vinyl material.

7. The portal frame for a building according to claim 6 in which said strips of decorative material comprise wood materials selected from the group of oak, maple, walnut, cherry, poplar or cedar.

8. The portal frame for a building according to claim 3 in which said elongate inner frame section is comprised of a steel material.

9. The portal frame for a building according to claim 8 in which said strips of decorative material comprise wood materials selected from the group of oak, maple, walnut, cherry, poplar or cedar.

10. A frame section for holding a window pane which comprises:

a. an elongate body having opposing inside and outside surfaces;

b. a window pane holding abutment surface intermediate said inside and outside surfaces;

c. means for slidingly connecting to a window slide mechanism located intermediate of said inside and outside surfaces and on an opposite side from said pane holding abutment surface;

d. rigid pronged projections extending along said inside surface;

e. strips of grooved decorative material having their grooves co-operatively connected over said rigid pronged projections so as to substantially cover said inside surface.

11. A frame section for holding a window pane according to claim 10 which said frame section is comprised of extruded aluminum.

12. A frame section for holding a window pane according to claim 10 in which said pane holding abutment surface comprises a channel having two side walls and a bottom wall joining said two side walls.

13. A frame section for holding a window pane according to claim 12 in which one of said side walls is formed by one or more of said strips of decorative material.

14. A frame section for holding a window pane according to claim 13 in which said rigid pronged projections face the same direction as said bottom wall.

15. A frame section for holding a window pane according to claim 14 in which said inside surface is stepped in configuration having at least two landed surfaces from which said rigid pronged projections may protrude.

16. A frame section for holding a window pane according to claim 15 in which there are at least two strips of decorative material placed along the landed areas with the innermost strip being only a fraction of the width of the outermost strip.

17. The portal frame for a building according to claim 13 in which said elongate inner frame section is formed of extruded aluminum.

18. The portal frame for a building according to claim 17 in which said strips of decorative material comprise wood materials selected from the group of oak, maple, walnut, cherry, poplar or cedar.

19. The portal frame for a building according to claim 13 in which said elongate inner frame section is formed of an extruded vinyl material.

20. The portal frame for a building according to claim 19 in which said strips of decorative material comprise wood materials selected from the group of oak, maple, walnut, cherry, poplar or cedar.

21. The portal frame for a building according to claim 13 in which said elongate inner frame section is comprised of a steel material.

22. The portal frame for a building according to claim 21 in which said strips of decorative material comprise wood materials selected from the group of oak, maple, walnut, cherry, poplar or cedar.

23. A window and portal frame for a building which comprises:

a. an elongate inner frame section having oppositely facing front and back sides and oppositely facing lateral sides;

b. said back side forming an abutment surface for abutting said inner frame to a framed opening;

c. said front side having means thereon for releasable attachment to window slide mechanisms;

d. rigid pronged projections extending outwardly from one of said lateral sides;

e. strips of grooved decorative material having their grooves co-operatively attached over said pronged projections so as to substantially cover said one lateral side;

f. an intermediate window slide mechanism;

g. an elongate pane frame body having opposing inside and outside surfaces;

h. a window pane holding abutment surface intermediate said inside and outside surfaces;

i. means for slidingly connecting to a window slide mechanism located intermediate of said inside and outside surfaces and on an opposite side from said pane holding abutment surface;

j. rigid pronged projections extending along said inside surface;

k. strips of grooved decorative material having their grooves co-operatively connected over said rigid pronged projections so as to substantially cover said inside surface.

24. The method of providing a window pane frame which comprises the steps of:

a. extruding a piece of material so as to form an elongate body having opposing inside and outside surfaces;

b. forming a window pane holding abutment surface intermediate said inside and outside surfaces by providing a side wall and bottom wall substantially at right angles to one another;

c. providing means for slidingly connecting said extruded material to a window slide mechanism;

d. forming rigid pronged projections extending along said inside surface;

e. forming strips of grooved decorative material and co-operatively connecting their grooves over said rigid pronged projections so as to substantially cover said inside surface;

f. forming an opposing abutment side wall to said first abutment side wall from one of said strips of decorative material.

25. The method of providing a window pane frame according to claim 24 which further comprises the step of forming the extruded elongate body from an aluminum material.

26. The method of providing a window pane frame according to claim 25 which further comprises the step of forming the decorative strips from a wood material consisting of a material from the group of oak, maple, walnut, cherry, poplar or cedar.

27. The method of providing a window pane frame according to claim 24 which further comprises the step of forming the extruded elongate body from a vinyl material.

28. The method of providing a window pane frame according to claim 27 which further comprises the step of forming the strips of decorative material from a wood material selected from the group of oak, maple, walnut, cherry, poplar or cedar.

29. The method of providing a window pane frame according to claim 24 which further comprises the step of forming the extruded elongate body from a steel material.

30. The method of providing a window pane frame according to claim 29 which further comprises the step of forming the strips of decorative material from a wood material selected from the group of oak, maple, walnut, cherry, poplar or cedar.

* * * * *